US009856716B2

(12) United States Patent
Reimer et al.

(10) Patent No.: US 9,856,716 B2
(45) Date of Patent: Jan. 2, 2018

(54) PRESSURE RELEASE ASSEMBLY FOR CASING OF DRILLING RIG

(71) Applicants: Quentin J. Reimer, Medicine Hat (CA); Colby L. Nafziger, Vermilion (CA)

(72) Inventors: Quentin J. Reimer, Medicine Hat (CA); Colby L. Nafziger, Vermilion (CA)

( * ) Notice: Subject to any disclaimer, the term of this patent is extended or adjusted under 35 U.S.C. 154(b) by 620 days.

(21) Appl. No.: 14/482,126

(22) Filed: Sep. 10, 2014

(65) Prior Publication Data

US 2016/0069154 A1 Mar. 10, 2016

(51) Int. Cl.

| | |
|---|---|
| ***E21B 34/02*** | (2006.01) |
| ***E21B 33/10*** | (2006.01) |
| ***E21B 33/04*** | (2006.01) |
| ***E21B 34/10*** | (2006.01) |
| ***E21B 47/10*** | (2012.01) |

(52) U.S. Cl.

CPC ..... *E21B 34/02* (2013.01); *E21B 33/04* (2013.01); *E21B 34/101* (2013.01); *E21B 47/1025* (2013.01)

(58) Field of Classification Search

CPC ..... E21B 34/02; E21B 34/101; E21B 33/04
See application file for complete search history.

(56) References Cited

U.S. PATENT DOCUMENTS 2,517,655 A 8/1950 Gillespie
2,517,870 A * 8/1950 Gump ..... E21B 33/068 166/85.1
2,644,486 A * 7/1953 Christensen ..... E21B 34/02 251/110
2,958,336 A * 11/1960 Yancey ..... E21B 34/02 137/454.2
3,133,593 A * 5/1964 Kimmell ..... E21B 34/02 166/92.1
4,290,759 A 9/1981 Seabourn et al.
4,452,304 A * 6/1984 Barrier ..... E21B 33/068 166/120
4,825,945 A * 5/1989 Smith ..... E21B 34/02 137/523
5,289,883 A 3/1994 Robinson
5,501,280 A 3/1996 Brisco
(Continued)

FOREIGN PATENT DOCUMENTS

| | | |
|---|---|---|
| CA | 2086876 | 8/1993 |
| CA | 2517895 | 12/2009 |

OTHER PUBLICATIONS

Schlumberger Oilfield Glossary entries for "casing" and "rig", accessed on Apr. 5, 2017 via www.glossary.oilfield.slb.com.*

*Primary Examiner* — Blake E Michener

(57) ABSTRACT

An apparatus is for a drill rig platform configured to be operative with a casing system having a check valve fixedly positioned in a casing joint. The apparatus includes a casing pressure relief assembly fixedly positionable relative to the check valve positioned in the casing system. The casing pressure relief assembly is configured to actuate the check valve in such a way that the check valve actuatably releases internal pressure from the casing system. In this manner, the internal fluid pressure of the pressurized fluid trapped in the casing system is released once the casing pressure relief assembly actuates the check valve.

15 Claims, 12 Drawing Sheets

(56) References Cited

U.S. PATENT DOCUMENTS

| | | | | |
|---|---|---|---|---|
| 5,865,250 | A * | 2/1999 | Gariepy | E21B 33/04 166/375 |
| 5,988,282 | A * | 11/1999 | Jennings | E21B 34/02 166/348 |
| 6,116,268 | A * | 9/2000 | Johnson | E21B 34/16 137/458 |
| 6,119,773 | A * | 9/2000 | Gariepy | E21B 33/04 166/375 |
| 6,367,323 | B1 | 4/2002 | Camwell et al. | |
| 7,793,729 | B2 | 9/2010 | Nikiforuk | |
| 8,281,875 | B2 | 10/2012 | Lovorn et al. | |
| 2010/0258319 | A1* | 10/2010 | Nguyen | E21B 23/02 166/373 |
| 2011/0011575 | A1* | 1/2011 | Nguyen | E21B 23/01 166/87.1 |
| 2011/0011598 | A1* | 1/2011 | Nguyen | E21B 23/01 166/386 |
| 2011/0203802 | A1 | 8/2011 | Curtis et al. | |
| 2012/0318519 | A1* | 12/2012 | Webb | E21B 33/064 166/358 |
| 2013/0192849 | A1* | 8/2013 | Blake | E21B 34/10 166/374 |
| 2014/0048255 | A1* | 2/2014 | Baca | E21B 33/068 166/250.1 |
| 2014/0182863 | A1* | 7/2014 | Nguyen | E21B 23/01 166/379 |
| 2014/0196908 | A1* | 7/2014 | Nguyen | E21B 23/01 166/373 |
| 2016/0186527 | A1* | 6/2016 | Cocker, III | E21B 34/02 166/379 |

* cited by examiner

PRESSURE RELEASE ASSEMBLY FOR CASING OF DRILLING RIG

TECHNICAL FIELD

Some aspects generally relate to (and are not limited to) an apparatus including a casing pressure relief assembly configured to actuatably release internal pressure from a casing system of a drilling rig platform (and method therefor).

BACKGROUND

A drilling rig platform is a machine configured to drill (create) a bore hole in the ground. The drilling rig platform houses equipment used to drill water wells, oil wells and/or natural gas extraction wells. The drilling rig platform may be deployed on a mobile platform or in a permanent land or marine-based structure (offshore oil rigs).

A mud pump circulates a drilling mud (slurry) through a drill bit and along a casing system. The casing system is also called a casing annulus or a pipe. The casing system is used for supporting the shape of the bore hole, and for cooling and removing the cuttings while drilling the well (bore hole). Hoists in the rig can lift hundreds of tons of pipe. The casing system is an outer (hollow) piping structure. The casing system is inserted into the bore hole (drilled by the drilling platform). The casing system holds back soil materials and stabilizes the bore hole.

By using a float collar on the top of a shoe joint and a guide or float shoe on the bottom, trapped internal pressure may occur in the casing system. The shoe joint is also called a casing joint and is a part of the casing system. Once the drill is activated, the fluid pump adds more internal pressure to the casing system. Once plugged, trapped internal casing pressure increases in the casing system. Removal of the unwanted plug from the casing system may be accomplished with finesse (operator skill and luck). Sometimes finessing the solution leads to more internal pressure trapped in the casing system. For instance, the internal pressure may reach up to 1,500 pounds per square inch (PSI) or higher. It is a dangerous task to relieve internal pressure from the casing system. This task endangers workers, wrecks equipment and creates unwanted environmental spillage.

SUMMARY

It will be appreciated there exists a need to mitigate (at least in part) problems associated with drilling rig platforms. After much study of the known systems and methods along with experimentation, an understanding of the problem and its solution has been identified and is articulated as follows:

To mitigate, at least in part, the problem(s) identified with existing systems and/or methods for drilling rig platforms, there is provided (in accordance with a major aspect) an apparatus for a drilling rig platform configured to be operative with a casing system having a check valve fixedly positioned in the casing system. The apparatus includes (and is not limited to) a casing pressure relief assembly fixedly positionable relative to the check valve. The casing pressure relief assembly is configured to actuate the check valve in such a way that the check valve actuatably releases internal pressure from the casing system. This is done in such a way that the internal fluid pressure of the pressurized fluid trapped in the casing system is released once the casing pressure relief assembly actuates the check valve.

To mitigate, at least in part, the problem(s) identified above, in accordance with another major aspect, there is provided an apparatus. The apparatus includes (and is not limited to) a combination of a casing system, a drilling rig platform, and a casing pressure relief assembly. The casing system has a check valve fixedly positioned in the casing system. The drilling rig platform is configured to be operative with the casing system. The casing pressure relief assembly is fixedly positionable relative to the check valve. The casing pressure relief assembly is configured to actuate the check valve in such a way that the check valve actuatably releases internal pressure from the casing system. This is done in such a way that the internal fluid pressure of the pressurized fluid trapped in the casing system is released once the casing pressure relief assembly actuates the check valve.

To mitigate, at least in part, the problem(s) identified above, in accordance with yet another major aspect, there is provided a method of operating a drilling rig platform configured to be operative with a casing system having a check valve fixedly positioned in the casing system. The method includes (and is not limited to) an operation (A) and an operation (B). The operation (A) includes fixedly positioning a casing pressure relief assembly relative to the check valve. The operation (B) includes using the casing pressure relief assembly to actuate the check valve in such a way that the check valve actuatably releases internal pressure from the casing system. This is done in such a way that the internal fluid pressure of the pressurized fluid trapped in the casing system is released once the casing pressure relief assembly actuates the check valve.

To mitigate, at least in part, the problem(s) identified above, in accordance with other aspects, there are provided aspects as identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken with the accompanying drawings, in which.

Figure 1B:
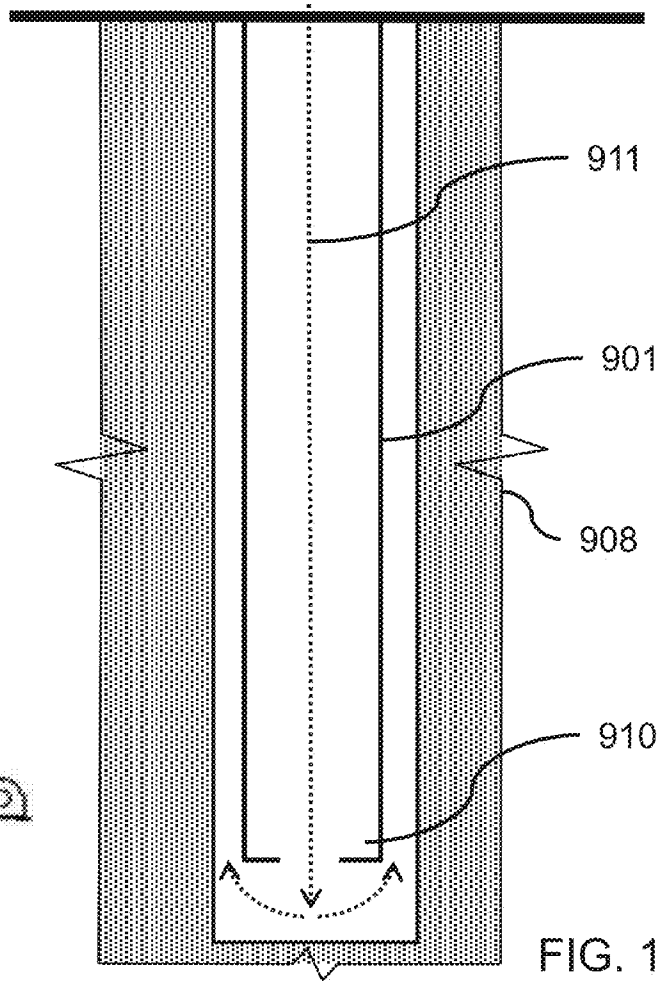
FIGS. 1*b*, 1*c* and 1*d* depict views of embodiments of a casing system usable with the drill rig platform of FIG. 1*a;*

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 casing pressure relief assembly
104 hydraulic pump
106 lock assembly
108 lock-connector assembly
110 container assembly
200 body member
202 casing-engagement member
204 lock-engagement member
206 hydraulically-operable actuator assembly
208 hydraulically-movable member
210 hydraulic fluid portal
300 collar portion
302 hinge assembly
304 lock-coupling assembly
306 pin assembly
308 pin lock
400 extension member
402 extension coupler
404 pin device
406 pin coupler device
408 connection device
900 drill rig platform
901 casing system
902 casing joint
904 casing collar
906 float collar
907 check valve
908 ground
910 casing shoe
911 fluid flow direction
912 exit flow direction

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

Figure 1A:
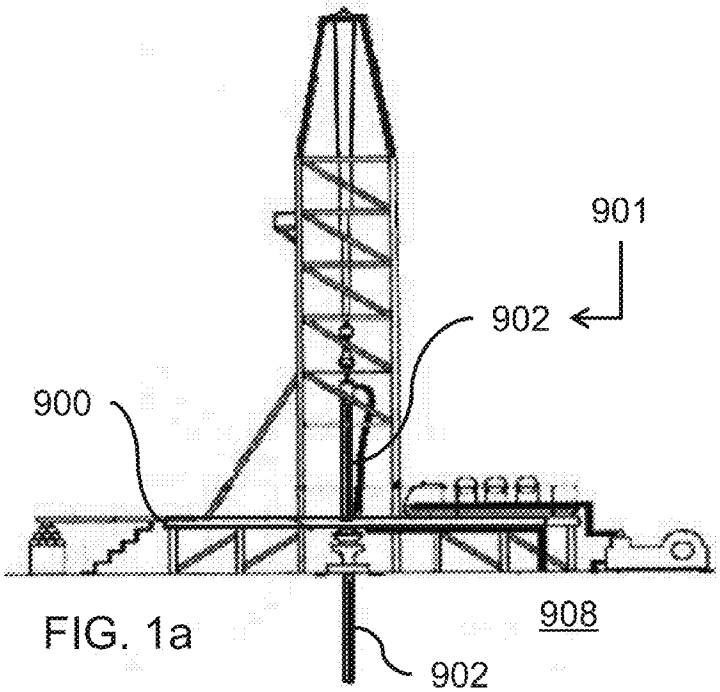
FIG. 1*a* depicts a view of an embodiment of a drill rig platform.

FIG. 1*a* depicts a view of an embodiment of a drill rig platform 900. FIG. 1*a* depicts a side view.

Referring to the embodiment depicted in FIG. 1*a*, the drill rig platform 900 is configured for drilling bore holes in the ground 908 (also called earth) in such a way that a resource fluid (such as, crude oil) may be extracted from the bore hole. The drill rig platform 900 may be configured for extracting other items (fluids) from the ground 908. The drill rig platform 900 includes a casing system 901 having a casing joint 902. The casing system 901 includes a hollow piping structure configured to extend into the ground 908. The casing system 901 is configured to be inserted into a bore hole drilled by the drill rig platform 900. The casing system 901 is inserted into the bore hole to hold back soil and stabilize the bore hole (to prevent unwanted collapse of the bore hole).

Figures 1C, 1D:
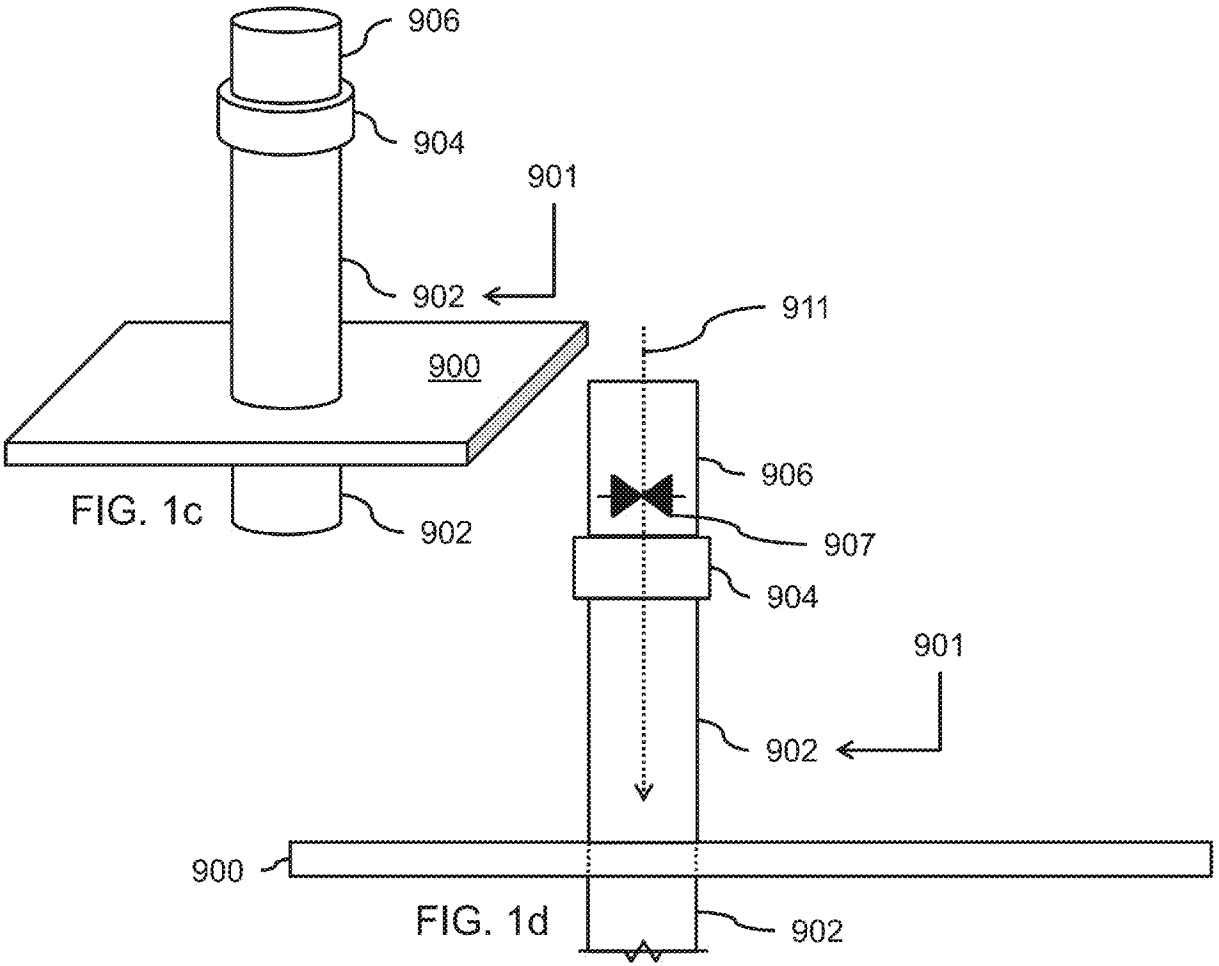

FIGS. 1*b*, 1*c* and 1*d* depict views of embodiments of a casing system 901 usable with the drill rig platform 900 of FIG. 1*a*. FIG. 1*b* depicts a side view. FIG. 1*c* depicts a perspective view. FIG. 1*d* depicts a side view.

Referring to the embodiment depicted in FIG. 1*b*, the casing system 901 extends (at least in part) into the ground 908. A casing shoe 910 is positioned at a distal end of the casing system 901. The casing shoe 910 terminates the casing system 901. The casing shoe 910 forms an exit portal configured to permit a flow of fluid (such as, a drilling fluid) along a fluid flow direction 911 that flows along the interior of the casing system 901 toward the distal end of the casing system 901. This is done in such a way that the pressurized fluid is permitted to flow from the interior of the casing system 901 to an exterior of the casing system 901 (via the exit portal of the casing shoe 910) between the casing system 901 and the ground 908 (in the bore hole that receives the casing system 901).

Referring to the embodiments depicted in FIGS. 1*c* and 1*d*, the casing system 901 includes (and is not limited to): a casing joint 902, a float collar 906, and a casing collar 904. The casing joint 902 is also called a shoe joint. The float collar 906 has a check valve 907 that is positioned (fixedly positioned) in the float collar 906. In this way, the check valve 907 is positioned in the interior of the casing system 901. The casing collar is also called a casing connector. The casing collar 904 is configured to connect the casing joint 902 to the float collar 906. For instance, the casing collar 904 threadably, securely and sealably couples (connects) the casing joint 902 with the float collar 906. The casing joint 902 passes through, at least in part, the drill rig platform 900. The check valve 907 normally operates in a directional flow-checked state (fluid flows one way). The pressurized fluid is permitted to flow into the float collar 906 through the check valve 907 and then toward the casing joint 902. The check valve 907 is configured to prevent reversed flow of fluid from the casing joint 902 toward the float collar 906. It will be appreciated that the check valve 907 is configured to permit the reverse flow of the pressurized fluid (once actuated to do just so). This is a desired state of operation of the check valve 907 when the drill rig platform 900 operates in a normal drilling mode (in which the drilling fluid is to be forced into the casing system 901 toward the ground 908, as depicted in FIGS. 1*a* and 1*b*, along the fluid flow direction 911).

Figure 2C:
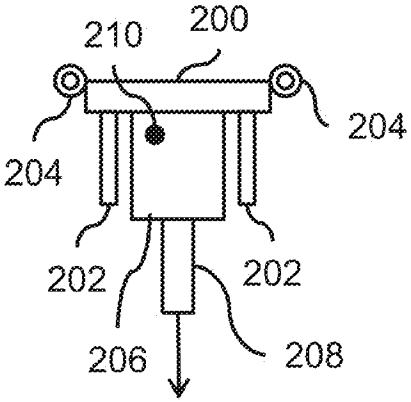
FIGS. 2*a*, 2*b*, 2*c*, 2*d* and 2*e* depict views of embodiments of an apparatus including a casing pressure relief assembly for use with the drill rig platform of FIG. 1*a* and/or with the casing system of FIGS. 1*b*, 1*c* and 1*d;*
Figure 2B:
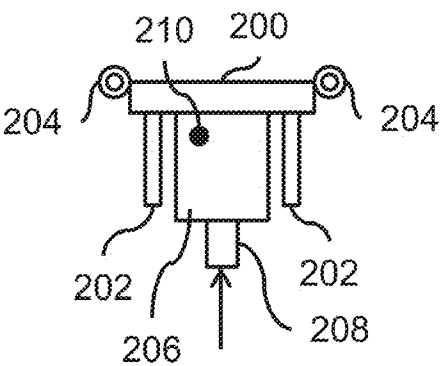
Figure 2A:
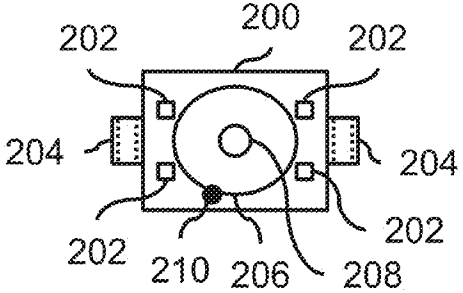
Figure 2D:
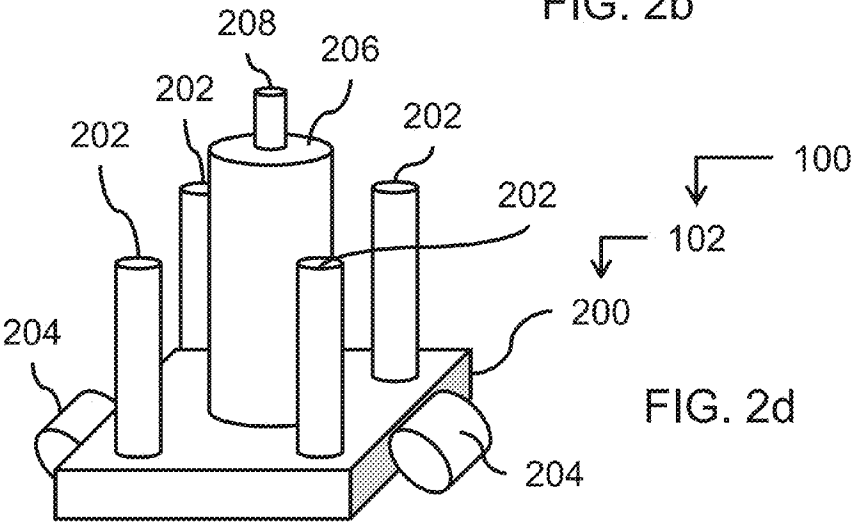
Figure 2E:
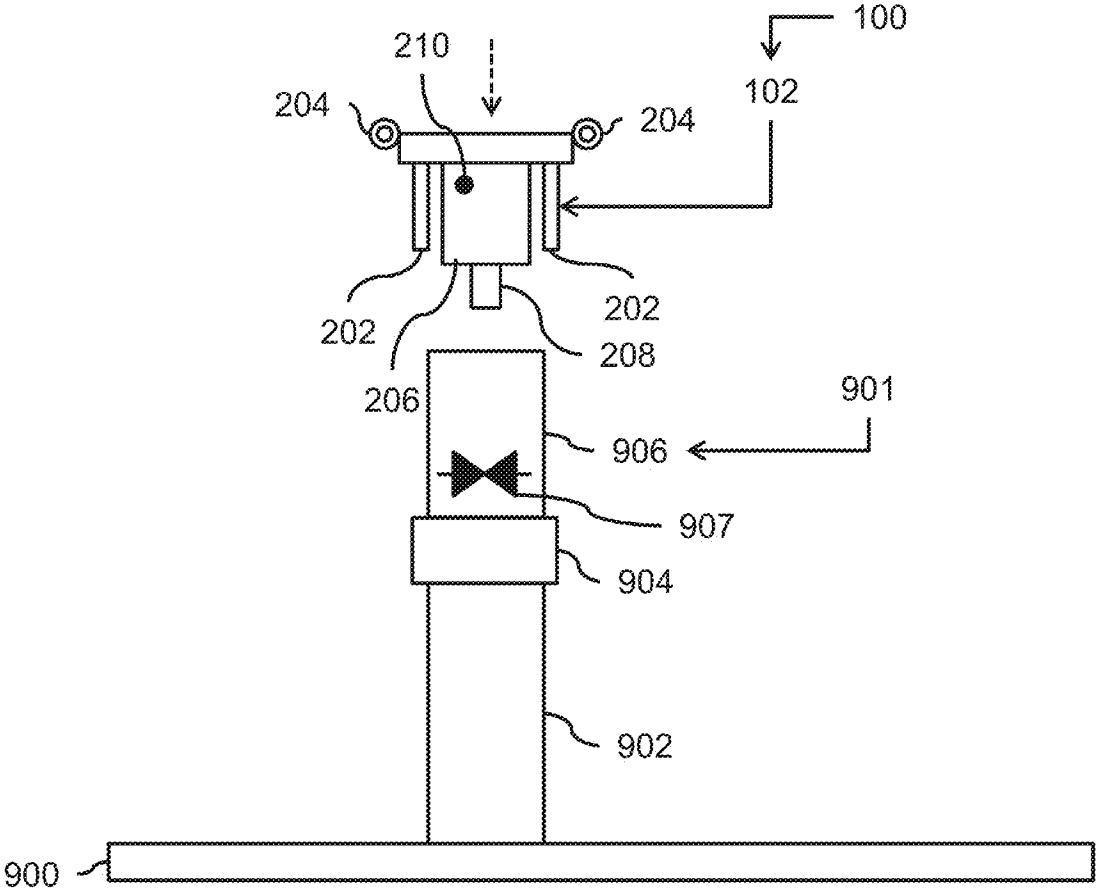

FIGS. 2*a*, 2*b*, 2*c*, 2*d* and 2*e* depict views of embodiments of an apparatus 100 including a casing pressure relief assembly 102 for use with the drill rig platform 900 of FIG. 1*a* and/or with the casing system 901 of FIGS. 1*b*, 1*c* and 1*d*. FIG. 2*a* depicts a top view. FIGS. 2*b* and 2*c* depict side views. FIG. 2*d* depicts a perspective view. FIG. 2*e* depicts a side view.

Referring to the embodiments depicted in FIGS. 2*a*, 2*b*, 2*c*, 2*d* and 2*e*, the casing pressure relief assembly 102 includes a hydraulically-operable actuator (and any equivalent thereof). It will be appreciated that any actuator may be deployed in the casing pressure relief assembly 102 (such as an electrically-based actuator). It will be appreciated that the actuator is configured to urge (force) the check valve 907 to open and permit flow of fluid from the interior of the casing system 901 to the exterior of the casing system 901, preferably, at the float collar 906.

For instance, the casing pressure relief assembly 102 includes a body member 200, a casing-engagement member 202, a lock-engagement member 204, and a hydraulically-operable actuator assembly 206. The casing-engagement member 202 is positioned relative to the body member 200. The lock-engagement member 204 is positioned relative to the body member 200. The hydraulically-operable actuator assembly 206 is positioned relative to the body member 200. The hydraulically-operable actuator assembly 206 has a hydraulically-movable member 208, and a hydraulic fluid portal 210. The hydraulically-movable member 208 is also called a hydraulic piston. The casing-engagement member 202 is configured to operatively position the casing pressure relief assembly 102 relative to the casing system 901. The lock-engagement member 204 is configured to lockably engage the casing pressure relief assembly 102 relative to the casing system 901. The hydraulically-operable actuator assembly 206 is configured to hydraulically move the hydraulically-movable member 208 in such a way as to actuate the check valve 907 to release an internal pressure from the casing system 901 in response to receiving a hydraulic fluid via the hydraulic fluid portal 210.

Specifically, four instances of the casing-engagement member 202 are depicted. There are two instances of the lock-engagement member 204 depicted. The hydraulically-movable member 208 is configured to open the check valve 907 (once the casing pressure relief assembly 102 is fixedly positioned relative to the check valve 907). The body member 200 is configured to be positioned at the open end of the float collar 906 (and to abut the float collar 906). The instances of the casing-engagement member 202 are spaced apart from each other, and extend from the body member 200 (in the same direction). The instances of the casing-engagement member 202 are spaced apart from each other; this is done in such a way that the casing pressure relief assembly 102 is mountable to the float collar 906 of the casing system 901 (as depicted in FIG. 2*e*). The instances of the casing-engagement member 202 stay (remain) exterior to the casing system 901 while the hydraulically-operable actuator assembly 206 extends (at least in part) into the interior of the float collar 906. The instances of the lock-engagement member 204 are positioned on opposite sides of the body member 200. The instances of the lock-engagement member 204 are configured to fixedly lock the casing pressure relief assembly 102 relative to the float collar 906 (once the casing pressure relief assembly 102 is mounted to the opening defined by the float collar 906). The hydraulically-operable actuator assembly 206 is attached to the body member 200, and extends in the same direction as the instances of the casing-engagement member 202. The hydraulically-movable member 208 is configured to move from an unactuated position (depicted in FIG. 2*b*) to an actuation position (depicted in FIG. 2*c*). This is done in response to the hydraulic fluid portal 210 receiving a hydraulic fluid (from a hydraulic fluid source). The body member 200 is configured to be positioned at the open end of the float collar 906 (and to abut the float collar 906) in such a way that the hydraulically-movable member 208 extends into the float collar 906 of the casing system 901, and the hydraulically-movable member 208 is interactable with the check valve 907 positioned in the interior of the float collar 906. The hydraulically-operable actuator assembly 206 is configured to move the hydraulically-movable member 208 in such a way as to activate the check valve 907; once the check valve 907 is activated, the pressurized fluid in the casing system 901 may flow in a direction such that the pressurized fluid flows out from within the casing system 901 to externally of the casing system 901 via the check valve 907 (in the opposite sense of the fluid flow direction 911 depicted in FIG. 1*d*).

Figure 3:
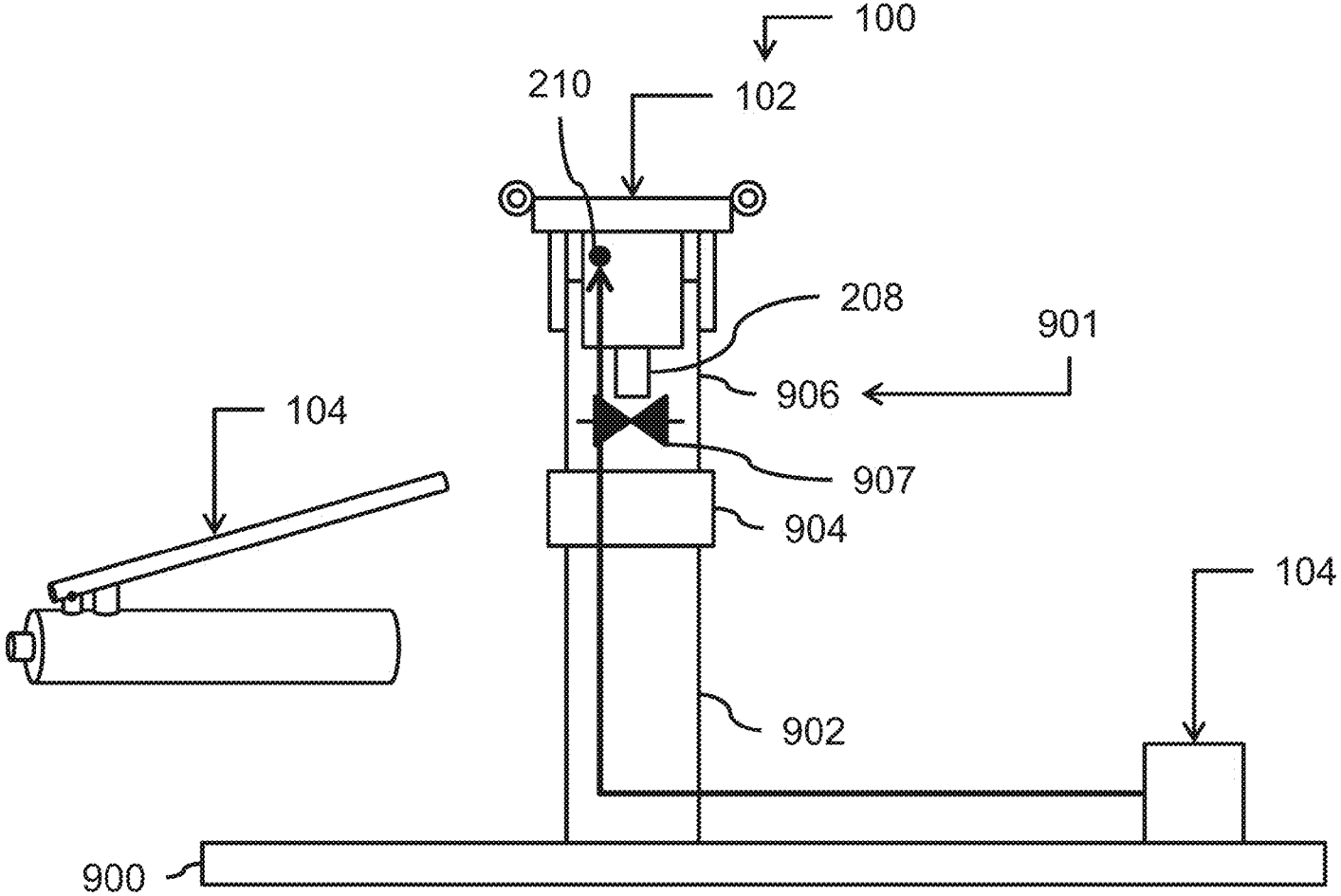
FIG. 3 depicts a view of an embodiment of a hydraulic pump of the apparatus of FIGS. 2*a*, 2*b*, 2*c*, 2*d* and 2*e;*

FIG. 3 depicts a view of an embodiment of a hydraulic pump 104 of the apparatus 100 of FIGS. 2*a*, 2*b*, 2*c*, 2*d* and 2*e*. FIG. 3 depicts a side view.

Referring to the embodiment depicted in FIG. 3, the casing pressure relief assembly 102 is installed (fixedly positioned) to the float collar 906 of the casing system 901. The hydraulic pump 104 is configured to be fluidly connected to the hydraulic fluid portal 210 of the casing pressure relief assembly 102. This is done in such a way that the hydraulic pump 104 moves hydraulic fluid into the casing pressure relief assembly 102 so the hydraulically-movable member 208 may operatively interact with the check valve 907 positioned in the float collar 906. The hydraulic pump 104 may be manually operable (as depicted) or may be power operated. As depicted in FIG. 3, it will be appreciated that the casing pressure relief assembly 102 is not yet fixedly connected to the float collar 906 (or the casing system 901). The hydraulic pump 104 is used (actuated) after the casing pressure relief assembly 102 is fixedly connected to the float collar 906 (as depicted in FIG. 7).

Figure 4C:
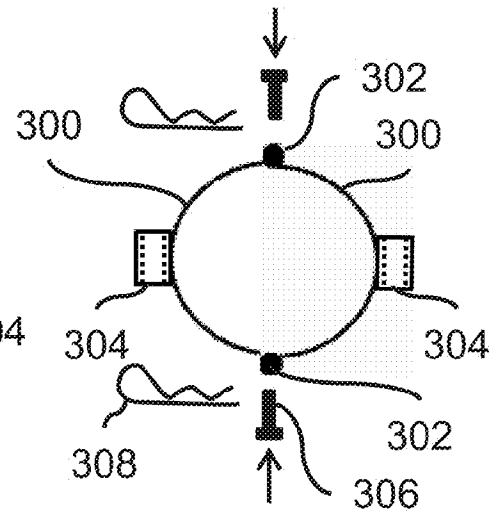
FIGS. 4*a*, 4*b*, 4*c*, 4*d*, 4*e*, 4*f* and 4*g* depict views of embodiments of a lock assembly of the apparatus of FIGS. 2*a*, 2*b*, 2*c*, 2*d* and 2*e;*
Figure 4B:
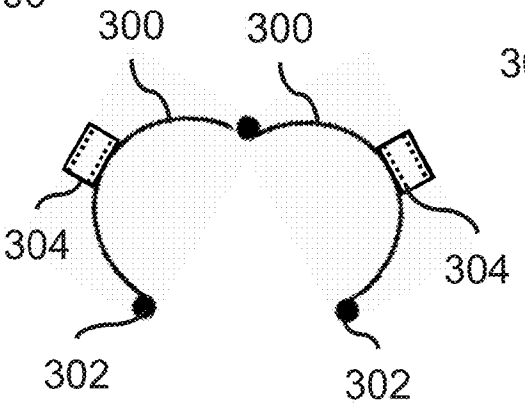
Figure 4A:
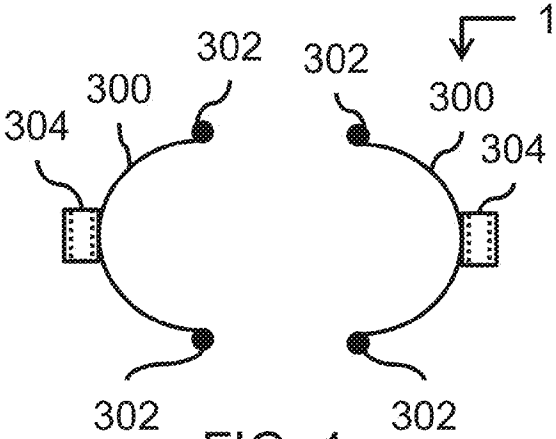
Figure 4F:
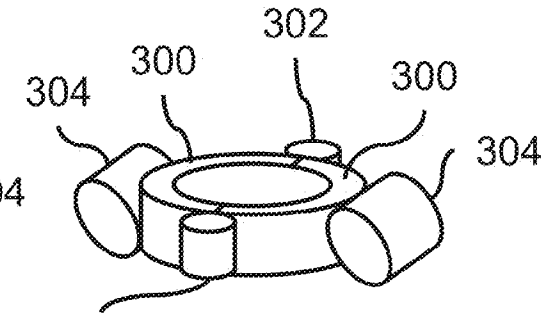
Figure 4E:
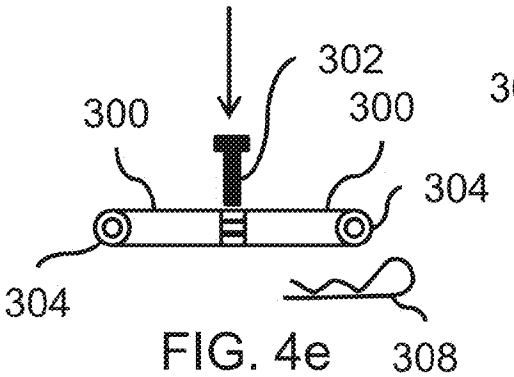
Figure 4D:
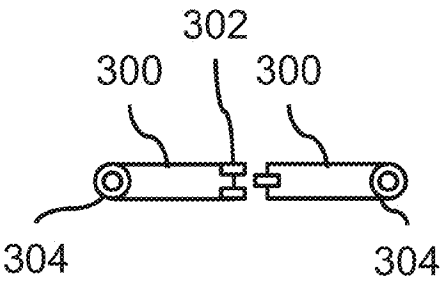
Figure 4G:
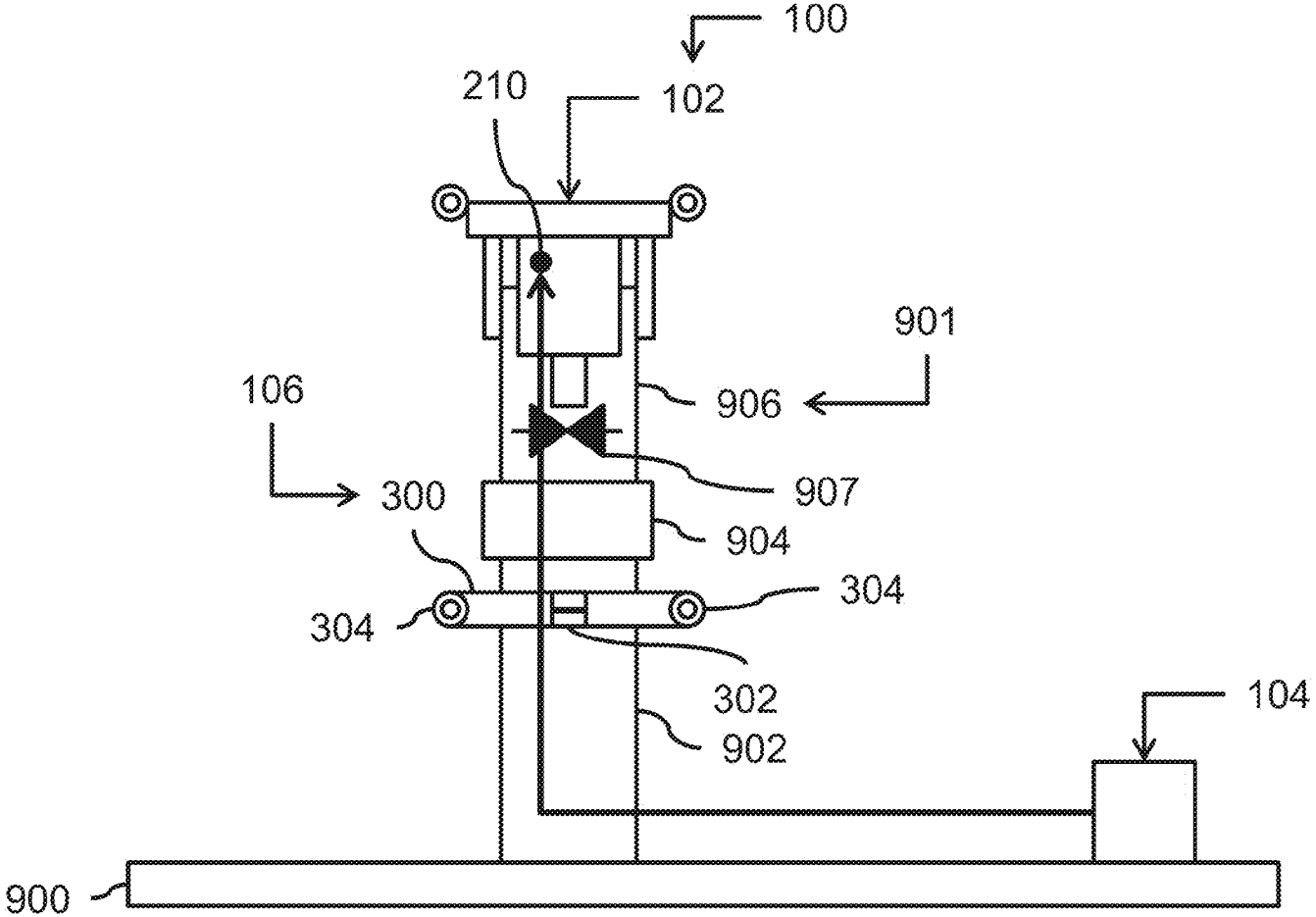

FIGS. 4*a*, 4*b*, 4*c*, 4*d*, 4*e*, 4*f* and 4*g* depict views of embodiments of a lock assembly 106 of the apparatus 100 of FIGS. 2*a*, 2*b*, 2*c*, 2*d* and 2*e*. FIGS. 4*a*, 4*b* and 4*c* depict side views. FIGS. 4*d* and 4*e* depict side views. FIG. 4*f* depicts a perspective view. FIG. 4*g* depicts a side view.

Figure 5B:
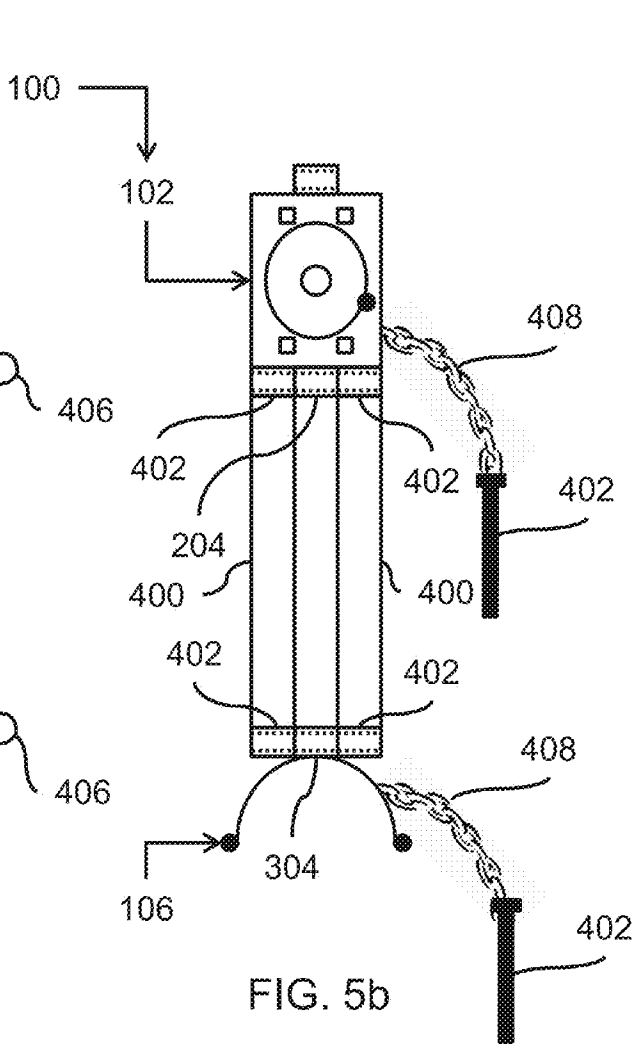
FIGS. 5*a*, 5*b*, 5*c*, 5*d*, 5*e* and 5*f* depict views of embodiments of a lock-connector assembly of the apparatus of FIGS. 2*a*, 2*b*, 2*c*, 2*d* and 2*e;*
Figure 5A:
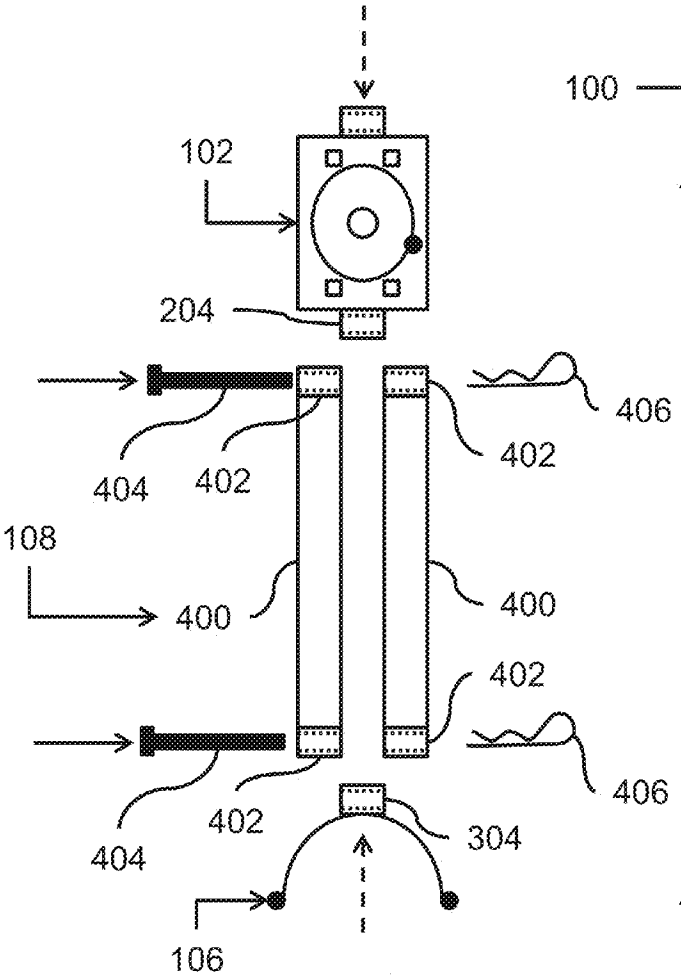
Figure 5E:
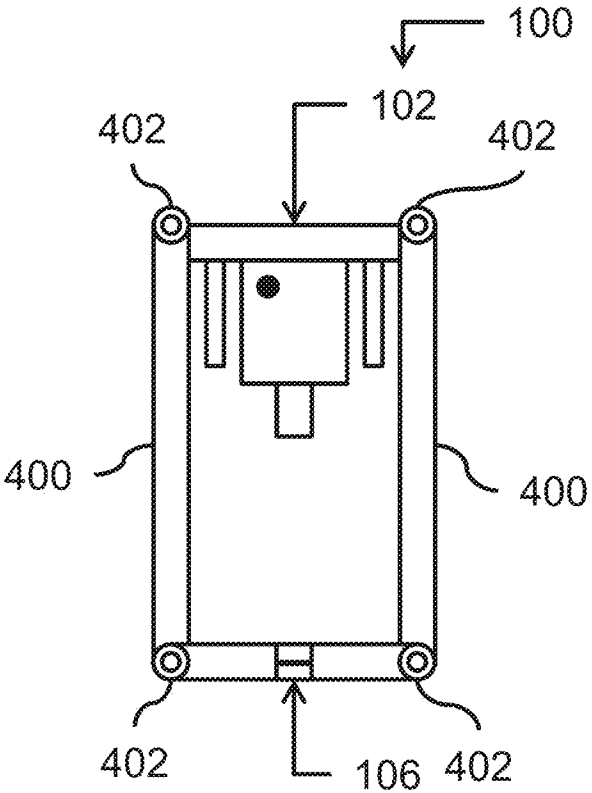
Figure 5D:
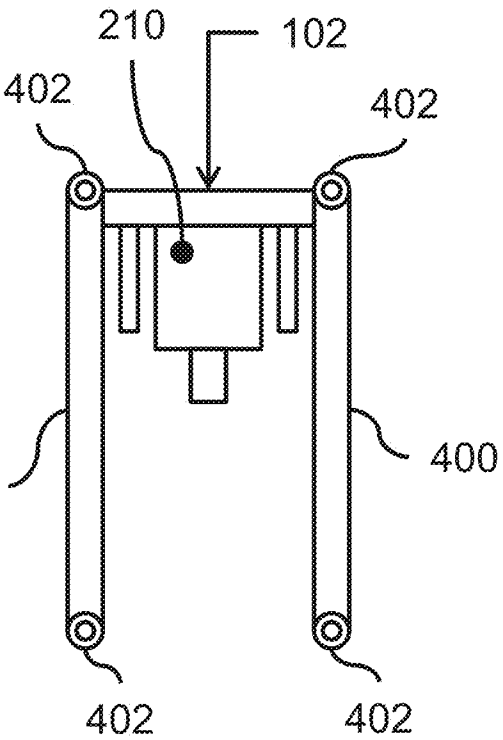
Figure 5C:
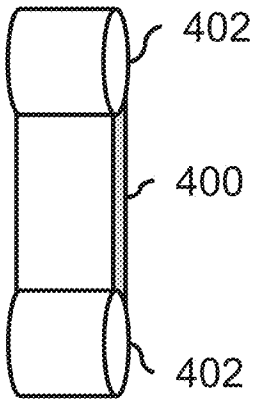
Figure 5F:
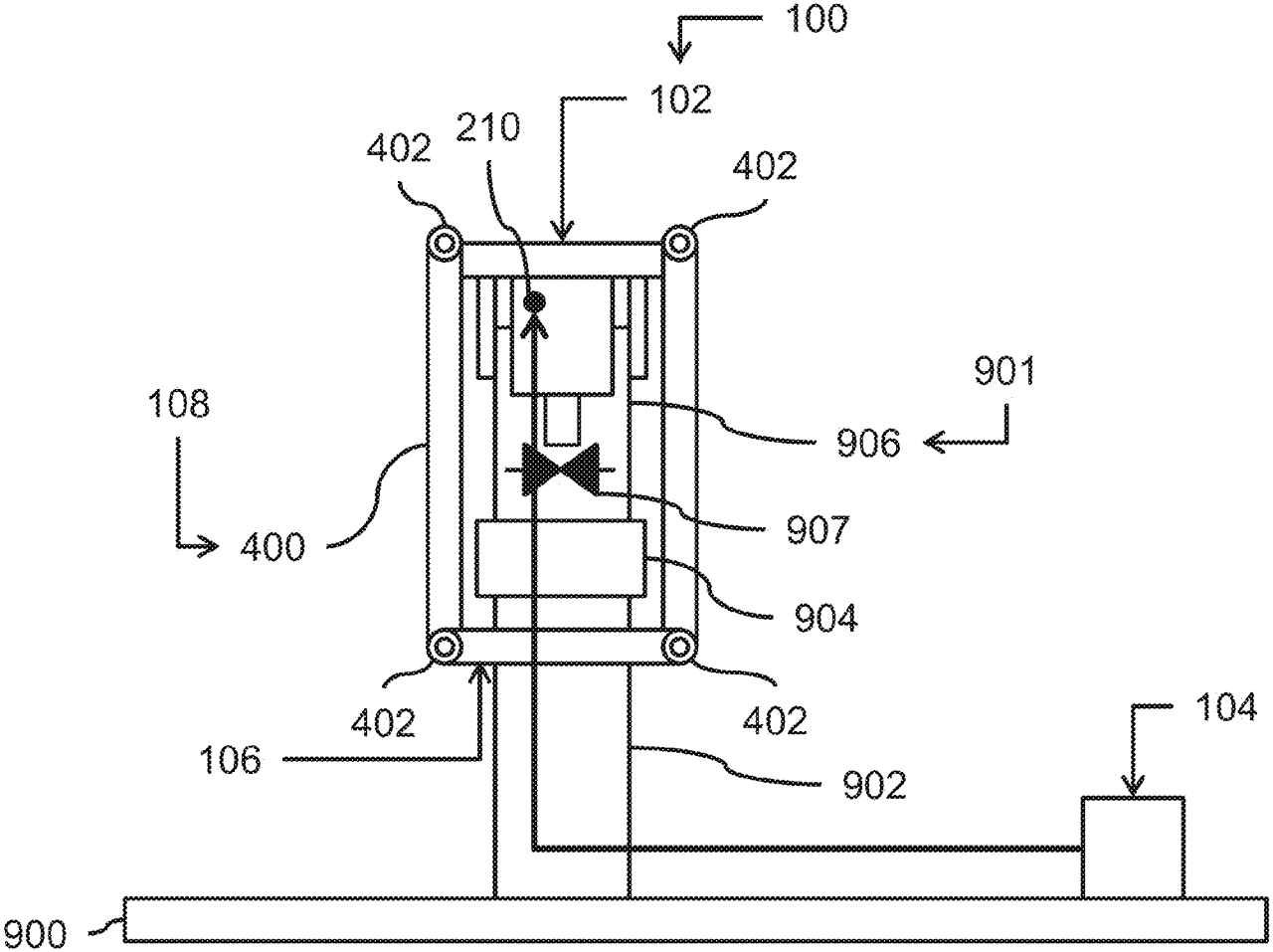
Figure 7:
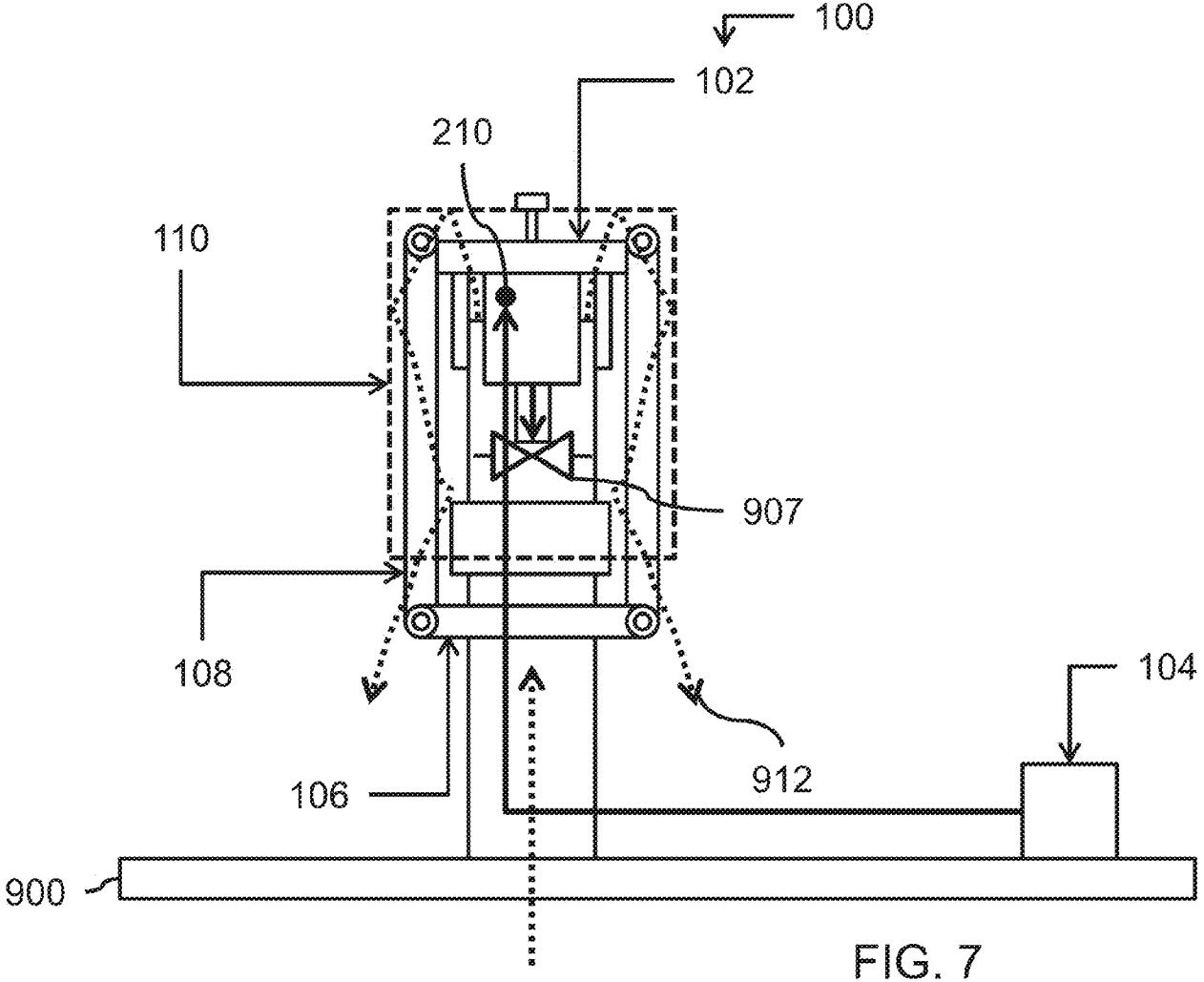
FIG. 7 depicts a view of embodiments of the apparatus (in use) of FIGS. 2*a*, 2*b*, 2*c*, 2*d* and 2*e*.

Referring to the embodiment depicted in FIG. 4*a*, the lock assembly 106 (also called a clamping assembly) is configured to securely lock (or clamp) to the casing system 901 (such as, the float collar 906 as depicted in FIG. 5*f* and FIG. 7). It will be appreciated that the lock assembly 106 may include any lock system (having suitable configuration). For example, the lock assembly 106 includes (and is not limited to) a collar portion 300, a hinge assembly 302, a lock-coupling assembly 304, a pin assembly 306, and a pin lock 308. The hinge assembly 302 is positioned relative to the collar portion 300. The lock-coupling assembly 304 is positioned relative to the collar portion 300. The pin assembly 306 is positioned relative to the collar portion 300. The pin lock 308 is positioned relative to the collar portion 300. The collar portion 300 is configured to securely connect to the casing system 901. The hinge assembly 302 is configured to fixedly connect with the collar portion 300, and to permit pivotal movement of the collar portion 300. The lock-coupling assembly 304 is configured to couple the collar portion 300 to a lock-connector assembly 108. The pin assembly 306 is configured to couple the hinge assembly 302 in such a way as to prevent pivotal movement of the collar portion 300. The pin lock 308 is configured to prevent the pin assembly 306 from inadvertently releasing movement of the collar portion 300.

As depicted, two instances of the collar portion 300 face each other. The collar portion 300 is configured to be contoured to the outer diameter of the float collar 906 as depicted in FIG. 4*g*. Instances of the hinge assembly 302 are positioned on end portions of each instance of the collar portion 300. The hinge assembly 302 is configured to pivotally attach the end portions of the collar portion 300 together. Instances of the lock-coupling assembly 304 are positioned on each instance of the collar portion 300. The lock-coupling assembly 304 is configured to couple the collar portion 300 to the casing pressure relief assembly 102, as depicted in FIG. 5*f*, via a connection structure depicted in FIG. 5*a*. Instances of the pin assembly 306 are configured to couple the hinge assembly 302 mounted to the collar portion 300. The pin lock 308 (also called a cotter pin) is configured to fixedly lock the pin assembly 306 in a stationary position; this is done in such a way as to secure the hinge assembly 302 together.

FIGS. 5*a*, 5*b*, 5*c*, 5*d*, 5*e* and 5*f* depict views of embodiments of a lock-connector assembly 108 of the apparatus 100 of FIGS. 2*a*, 2*b*, 2*c*, 2*d* and 2*e*. FIGS. 5*a* and 5*b* depict top views. FIG. 5*c* depicts a perspective view. FIGS. 5*d*, 5*e* and 5*f* depict side views.

Referring to the embodiments depicted in FIGS. 5*a*, 5*b*, 5*c*, 5*d*, 5*e* and 5*f*, the lock-connector assembly 108 is also called a leg assembly. It will be appreciated that the lock-connector assembly 108 may include many types of configurations. The lock-connector assembly 108 is configured to securely connect the casing pressure relief assembly 102 to the lock assembly 106. This is done in such a way that once the casing pressure relief assembly 102 is actuated, the casing pressure relief assembly 102 remains stationary while the check valve 907 is forced into a reverse flow condition (an open condition, as depicted in FIG. 7). For instance, the lock-connector assembly 108 includes (and is not limited to) an extension member 400, an extension coupler 402, a pin device 404, a pin coupler device 406, and a connection device 408 positioned relative to the extension member 400. The extension coupler 402 is positioned relative to the extension member 400. The pin device 404 is positioned relative to the extension member 400. The pin coupler device 406 is positioned relative to the extension member 400. The connection device 408 is positioned relative to the extension member 400. The pin coupler device 406 is also called a cotter pin. The connection device 408 is also called a chain. The extension member 400 is configured to extend between the casing pressure relief assembly 102 and the lock assembly 106. The extension coupler 402 and the pin device 404 are configured to couple the casing pressure relief assembly 102 to the lock assembly 106. The pin coupler device 406 is configured to securely prevent the pin device 404 from decoupling from the extension coupler 402. The connection device 408 (a chain) is configured to securely link the pin coupler device 406 to the casing pressure relief assembly 102 (so as to avoid accidental loss of the pin coupler device 406).

Specifically, the extension member 400 includes an elongated member. Instances of the extension coupler 402 are positioned at the opposite distal ends of the extension member 400. At one end of the extension member 400, the extension coupler 402 is configured to be aligned with the lock-engagement member 204 of the casing pressure relief assembly 102. At an opposite end of the extension member 400, the extension coupler 402 is configured to be aligned with the lock-coupling assembly 304 of the lock assembly 106. The pin device 404 is configured to slidably connect the extension coupler 402 to the lock-engagement member 204. The pin device 404 is configured to slidably connect the extension coupler 402 with the lock-coupling assembly 304. The pin coupler device 406 is configured to securely and fixedly connect the pin device 404 to the extension coupler 402 (so as to avoid inadvertent separation). The connection device 408 is configured to securely and flexibly connect the pin device 404 to the casing pressure relief assembly 102. The connection device 408 is configured to securely and flexibly connect the pin device 404 to the lock assembly 106.

Figures 6A, 6B:
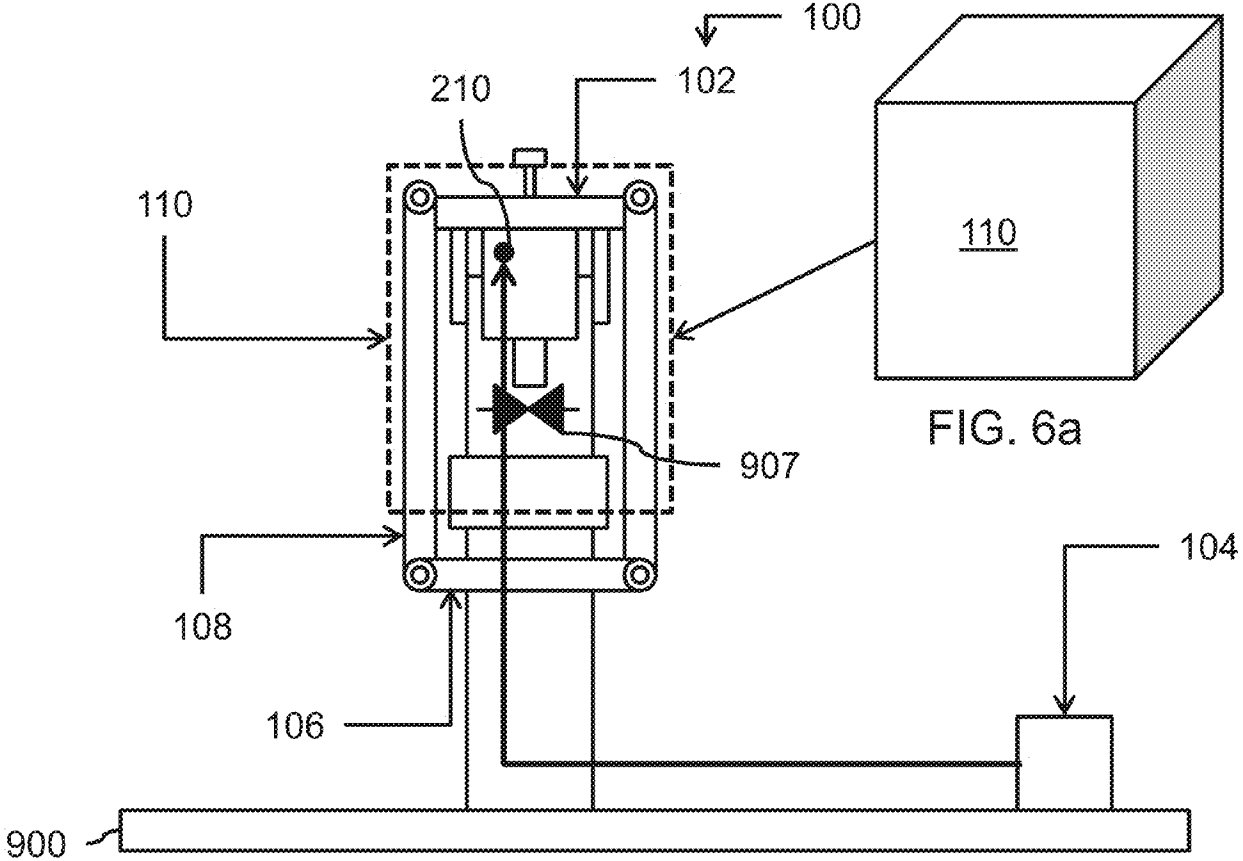
FIGS. 6*a* and 6*b* depict views of embodiments of a container assembly of the apparatus of FIGS. 2*a*, 2*b*, 2*c*, 2*d* and 2*e*.

FIGS. 6*a* and 6*b* depict views of embodiments of a container assembly 110 of the apparatus 100 of FIGS. 2*a*, 2*b*, 2*c*, 2*d* and 2*e*. FIG. 6*a* depicts a perspective view. FIG. 6*b* depicts a side view.

Referring to the embodiments depicted in FIGS. 6*a* and 6*b*, the container assembly 110 defines a hollow interior. The container assembly 110 is operatively mounted relative to the casing pressure relief assembly 102 in such a way that the container assembly 110 covers (shields) the casing pressure relief assembly 102 (and deflects pressurized fluid ejected from the casing system 901 to be directed toward a safe direction away from the operator). The container assembly 110 may be made from any suitable shape or form, and may have any suitable material (steel, etc.).

The casing pressure relief assembly 102 is positioned or placed on the float collar 906. Once positioned and securely installed as depicted in FIG. 6, the operator stands at a safe distance from the casing pressure relief assembly 102. The operator may keep a visual check on the casing pressure relief assembly 102 and the float collar 906 while the operator is positioned at a remote and safe place. Once the operator is positioned in a safe place, the casing pressure relief assembly 102 may be operated to release pressure from the float collar 906 (or other components, such as the casing joint 902). Advantageously, the casing pressure relief assembly 102 is configured to relieve the internal fluid pressure of the pressurized fluid trapped in the float collar 906 in a safe manner (for the case where the casing joint 902 has become inadvertently plugged resulting in no flow of fluid along the casing system 901).

The casing pressure relief assembly 102 reduces, at least in part, the danger that arises when the casing joint 902 becomes inadvertently plugged. The casing pressure relief assembly 102 permits the operator to remotely release fluid pressure from the float collar 906 (the operator may be positioned remotely from the check valve 907). This configuration reduces (at least in part) the possibility of loss of life, unwanted equipment damage, and occurrences of unwanted environmental spills from the casing system 901.

The casing pressure relief assembly 102 is fixedly (securely) installed on the float collar 906 (proximate to the check valve 907). The casing pressure relief assembly 102 is configured to (remotely) relieve trapped fluid pressure between the float collar 906 and the casing joint 902. The casing pressure relief assembly 102 is placed on top of the float collar 906 when the casing joint 902 becomes plugged. The casing pressure relief assembly 102 is remotely actuated by the operator positioned at a safe distance from the check valve 907, and allows the check valve 907 to actuate and release internal pressure from the interior of the float collar 906. The casing pressure relief assembly 102 is configured to be installed to a casing system 901 of a drill rig platform 900 used in the oil and gas industry.

FIG. 7 depicts a view of the embodiments of the apparatus 100 (in use) of FIGS. 2*a*, 2*b*, 2*c*, 2*d* and 2*e*. FIG. 7 depicts a side view.

Referring to the embodiment depicted in FIG. 7, the casing pressure relief assembly 102 is actuated (by the hydraulic pump 104). This is done in such a way that the check valve 907 is forced to an open condition in which fluid may flow from the interior of the casing system 901 to the exterior of the casing system 901 (from the opening defined by the float collar 906). The flow of the pressurized fluid leaves the casing system 901 along the exit flow direction 912 (as depicted).

Referring to FIG. 7, the apparatus 100 includes a casing pressure relief assembly 102. The apparatus 100 is for the drill rig platform 900 configured to be operative with a casing system 901. The casing system 901 has a check valve 907 fixedly positioned there in (such as, in a casing joint 902 of the casing system 901). The casing pressure relief assembly 102 is fixedly positionable relative to a check valve 907. The check valve 907 is fixedly positioned in a casing joint 902 of a casing system 901. Specifically, the check valve 907 is fixedly positioned in a float collar 906 extending from the casing joint 902. The casing pressure relief assembly 102 is configured to actuate the check valve 907 in such a way that the check valve 907 actuatably releases internal pressure from the casing joint 902. In this manner, the internal fluid pressure of fluid trapped in the casing joint 902 is released once the casing pressure relief assembly 102 is actuated. The casing joint 902 is also called a shoe joint. In this manner, the pressurized fluid in the casing joint 902 is released before the casing system 901 or the casing joint 902 is inspected by an operator (before service is rendered to the casing system 901).

The check valve 907 is also called a clack valve, a non-return valve, or a one way valve. The check valve 907 is configured to normally permit (allow) fluid (liquid or gas) to flow through the check valve 907 in only one direction (from an entrance portal to an exit portal). The check valve 907 also includes a pressure relief device configured to permit the pressurized fluid to flow through the check valve 907 from the exit portal to the entrance portal once the pressure relief device is enabled to do just so. The check valve 907 is a two-port valve, meaning the check valve 907 has two openings in a valve body: one opening (the entrance portal) for fluid to enter and the other opening (the exit portal) for fluid to leave. The check valve 907 operates under a cracking pressure that is the minimum upstream pressure (from entrance portal to exit portal) at which the check valve 907 operates to permit normal flow of fluid.

Referring to FIGS. 1 and 7, in accordance with a first major embodiment, the apparatus 100 is for the drill rig platform 900 (depicted in FIG. 1) configured to be operative with the casing system 901 having the check valve 907 fixedly positioned in the casing system 901. The apparatus 100 includes (and is not limited to) a casing pressure relief assembly 102 fixedly positionable relative to the check valve 907. The casing pressure relief assembly 102 is configured to actuate the check valve 907 in such a way that the check valve 907 actuatably releases internal pressure from the casing system 901. This is done in such a way that the internal fluid pressure of the pressurized fluid trapped in the casing system 901 is released once the casing pressure relief assembly 102 actuates the check valve 907. It will be appreciated that in accordance with a specific choice, the casing system 901 includes the float collar 906 extending from the casing joint 902, and the check valve 907 is fixedly positioned in the float collar 906.

Referring to FIGS. 1 and 7, in accordance with a second major embodiment, the apparatus 100 includes (and is not limited to) the combination of: the casing system 901, the drill rig platform 900, and the casing pressure relief assembly 102. The casing system 901 has the check valve 907 fixedly positioned in the casing system 901. The drill rig platform 900 is configured to be operative with the casing system 901. The casing pressure relief assembly 102 is fixedly positionable relative to the check valve 907. The casing pressure relief assembly 102 is configured to actuate the check valve 907 in such a way that the check valve 907 actuatably releases internal pressure from the casing system 901. This is done in such a way that the internal fluid pressure of the pressurized fluid trapped in the casing system 901 is released once the casing pressure relief assembly 102 actuates the check valve 907. It will be appreciated that, in accordance with a specific choice (option), the casing system 901 includes the float collar 906 extending from the casing joint 902, and the check valve 907 is fixedly positioned in the float collar 906.

Referring to the embodiment depicted in FIGS. 1 and 7, and in view of the foregoing, it will be appreciated that, in accordance with a third major embodiment, there is provided a method of operating the drill rig platform 900 configured to be operative with the casing system 901 having the check valve 907 fixedly positioned in the casing system 901. The method includes (and is not limited to) an operation (A) and an operation (B). The operation (A) includes fixedly positioning a casing pressure relief assembly 102 relative to the check valve 907. The operation (B) includes using the casing pressure relief assembly 102 to actuate the check valve 907 in such a way that the check valve 907 actuatably releases internal pressure from the casing system 901. This is done in such a way that the internal fluid pressure of the pressurized fluid trapped in the casing system 901 is released once the casing pressure relief assembly 102 actuates the check valve 907. It will be appreciated that in accordance with a specific option, the casing system 901 includes the float collar 906 extending from the casing joint 902, and the check valve 907 is fixedly positioned in the float collar 906.

It will be appreciated there are many ways in which the casing joint 902 may become plugged. For instance, sand, gravel, lost circulation materials, mud rings, dropped materials, tools and/or rags may become inadvertently positioned inside casing joint 902, etc.

Referring to the embodiment depicted in FIG. 7, by using the casing pressure relief assembly 102, an operator may remain advantageously at a safe distance away from the casing joint 902 while the check valve 907 is released (to release the internal pressure in the casing joint 902). The casing pressure relief assembly 102 is actuated by slowly inserting hydraulic fluid into the casing pressure relief assembly 102 to the point where the check valve 907 is actuated to release internal pressure held in the casing joint 902. The pressurized fluid (such as mud and/or water) will strike the top section of the container assembly 110 and direct fluid down hole, saving an environmental spill. Once the pressure has been relieved, the operator may clean out the casing joint 902 and reuse the casing joint 902 with all its components saving on equipment damage to the casing joint 902 and/or the casing system 901.

This written description uses examples to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims.

It may be appreciated that the assemblies and modules described above may be connected with each other as required to perform desired functions and tasks within the scope of persons of skill in the art to make such combinations and permutations without having to describe each and every one in explicit terms. There is no particular assembly, or component that may be superior to any of the equivalents available to the person skilled in art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a casing pressure relief assembly being fixedly positionable relative to a check valve, in which the check valve is fixedly positionable in a casing system, and in which the casing system is configured to be received and supported by a drill rig platform; and the casing pressure relief assembly being configured to actuate the check valve in such a way that the check valve, in use, actuatably releases internal pressure from the casing system; and a lock assembly and a lock-connector assembly being configured to securely lock and connect the casing pressure relief assembly to the casing system in such a way that the lock assembly and the lock-connector assembly, in use, maintain the casing pressure relief assembly stationary relative to the casing system while the check valve is forced into an open condition once the casing pressure relief assembly is actuated by a hydraulic pump, in which the hydraulic pump is configured to be fluidly connected to a hydraulic fluid portal of the casing pressure relief assembly, and move, in use, a hydraulic fluid into the casing pressure relief assembly so that a hydraulically-movable member, in use, interacts with the check valve positioned in the casing system; and a container assembly defining a hollow interior, and the container assembly being configured to shield the casing pressure relief assembly in such a way that the container assembly, in use, deflects a pressurized fluid that is ejected from the casing system toward a safe direction away from an operator; and whereby an internal fluid pressure of the pressurized fluid being trapped in the casing system is released once the casing pressure relief assembly, in use, actuates the check valve.

2. The apparatus of claim 1, wherein:

the casing pressure relief assembly includes:

a body member;

a casing-engagement member positioned relative to the body member;

a lock-engagement member positioned relative to the body member; and a hydraulically-operable actuator assembly positioned relative to the body member, and the hydraulically-operable actuator assembly having:

the hydraulically-movable member; and the hydraulic fluid portal.

3. The apparatus of claim 2, wherein:

the casing-engagement member is configured to position the casing pressure relief assembly to the casing system.

4. The apparatus of claim 3, wherein:

the lock-engagement member is configured to lockably engage the casing pressure relief assembly relative to the casing system.

5. The apparatus of claim 4, wherein:

the hydraulically-operable actuator assembly is configured to hydraulically move the hydraulically-movable member in such a way as to actuate the check valve to release the internal fluid pressure from the casing system in response to receiving the hydraulic fluid via the hydraulic fluid portal.

6. The apparatus of claim 1, wherein:

the hydraulic pump is configured to be fluidly connected to the hydraulic fluid portal of the casing pressure relief assembly, in such a way that the hydraulic pump moves the hydraulic fluid into the casing pressure relief assembly so that the hydraulically-movable member, in use, interacts with the check valve.

7. The apparatus of claim 1, wherein:

the lock assembly is configured to securely lock to the casing system.

8. The apparatus of claim 1, wherein:

the lock assembly includes:

a collar portion;

a hinge assembly positioned relative to the collar portion;

a lock-coupling assembly positioned relative to the collar portion;

a pin assembly positioned relative to the collar portion; and a pin lock positioned relative to the collar portion.

9. The apparatus of claim 8, wherein:

the collar portion is configured to securely connect to the casing system;

the hinge assembly is configured to permit pivotal movement of the collar portion;

the lock-coupling assembly is configured to couple the collar portion to the lock-connector assembly;

the pin assembly is configured to couple the hinge assembly in such a way as to prevent pivotal movement of the collar portion.

10. The apparatus of claim 1, wherein:

the lock-connector assembly includes:

an extension member;

an extension coupler positioned relative to the extension member;

a pin device positioned relative to the extension member;

a pin coupler device positioned relative to the extension member; and a connection device positioned relative to the extension member.

11. The apparatus of claim 10, wherein:

the extension coupler and the pin device are configured to couple the casing pressure relief assembly to the lock assembly.

12. The apparatus of claim 11, wherein:

the pin coupler device is configured to securely prevent the pin device from decoupling from the extension coupler; and the connection device is configured to securely link the pin coupler device.

13. An apparatus, comprising:

a casing system having a check valve fixedly positioned in the casing system; and a drill rig platform being configured to receive and support the casing system; and a casing pressure relief assembly being fixedly positionable relative to the check valve; and the casing pressure relief assembly being configured to actuate the check valve in such a way that the check valve, in use, actuatably releases internal pressure from the casing system; and a lock assembly and a lock-connector assembly being configured to securely lock and connect the casing pressure relief assembly to the casing system in such a way that the lock assembly and the lock-connector assembly, in use, maintain the casing pressure relief assembly stationary relative to the casing system while the check valve is forced into an open condition once the casing pressure relief assembly is actuated by a hydraulic pump in which the hydraulic pump is configured to be fluidly connected to a hydraulic fluid portal of the casing pressure relief assembly, and move, in use, a hydraulic fluid into the casing pressure relief assembly so that a hydraulically-movable member, in use, interacts with the check valve positioned in the casing system; and a container assembly defining a hollow interior, and the container assembly being configured to shield the casing pressure relief assembly in such a way that the container assembly, in use, deflects a pressurized fluid that is ejected from the casing system toward a safe direction away from an operator; and whereby an internal fluid pressure of a fluid trapped in the casing system is released once the casing pressure relief assembly, in use, actuates the check valve.

14. The apparatus of claim 13, wherein:

the casing system includes a float collar extending from a casing joint; and the check valve is fixedly positioned in the float collar.

15. A method of operating a check valve, the method comprising:

fixedly positioning a casing pressure relief assembly relative to the check valve, in which the check valve is fixedly positionable in a casing system, and in which the casing system is configured to be received and supported by the drill rig platform; and using the casing pressure relief assembly to actuate the check valve in such a way that the check valve, in use, actuatably releases internal pressure from the casing system; and using a lock assembly and a lock-connector assembly to securely lock and connect the casing pressure relief assembly to the casing system in such a way that the lock assembly and the lock-connector assembly, in use, maintain the casing pressure relief assembly stationary relative to the casing system while the check valve is forced into an open condition once the casing pressure relief assembly is actuated by a hydraulic pump in which the hydraulic pump is configured to be fluidly connected to a hydraulic fluid portal of the casing pressure relief assembly, and move, in use, a hydraulic fluid into the casing pressure relief assembly so that a hydraulically-movable member, in use, interacts with the check valve positioned in the casing system; and using a container assembly, in which the container assembly defines a hollow interior, to shield the casing pressure relief assembly in such a way that the container assembly, in use, deflects a pressurized fluid that is ejected from the casing system toward a safe direction away from an operator; and whereby an internal fluid pressure of a fluid trapped in the casing system is released once the casing pressure relief assembly, in use, actuates the check valve.

* * * * *